US007463109B2

(12) United States Patent
Iio

(10) Patent No.: US 7,463,109 B2
(45) Date of Patent: Dec. 9, 2008

(54) APPARATUS AND METHOD FOR WAVEGUIDE TO MICROSTRIP TRANSITION HAVING A REDUCED SCALE BACKSHORT

(75) Inventor: Kenichi Iio, Nishinomiya (JP)

(73) Assignee: Furuno Electric Company Ltd., Hyogo Pref. (JP)

( * ) Notice: Subject to any disclaimer, the term of this patent is extended or adjusted under 35 U.S.C. 154(b) by 69 days.

(21) Appl. No.: 11/404,903

(22) Filed: Apr. 17, 2006

(65) Prior Publication Data

US 2006/0255875 A1 Nov. 16, 2006

Related U.S. Application Data

(60) Provisional application No. 60/672,009, filed on Apr. 18, 2005.

(51) Int. Cl.
*H01P 5/107* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS 5,235,300 A * 8/1993 Chan et al. ..... 333/247
5,912,598 A 6/1999 Stones et al.
6,002,305 A 12/1999 Sanford et al.
6,242,984 B1 * 6/2001 Stones et al. ..... 330/295
6,707,348 B2 3/2004 Ammar
6,967,542 B2 * 11/2005 Weinstein ..... 333/26
7,148,766 B2 * 12/2006 Tong et al. ..... 333/26
2005/0200424 A1 * 9/2005 Takeda et al. ..... 333/26

FOREIGN PATENT DOCUMENTS

JP 60-230701 11/1985
JP 2003-298322 10/2003
JP 2005-318632 11/2005

* cited by examiner

*Primary Examiner*—Benny Lee
(74) *Attorney, Agent, or Firm*—Birch, Stewart, Kolasch & Birch, LLP

(57) ABSTRACT

Methods and apparatuses are directed to a transition between a waveguide and a microstrip. One embodiment features an open-ended waveguide having an exposed side at a distal end, a substrate coupled to the open-ended waveguide at a proximate end, a resonator coupled to the substrate, a microstrip line electromagnetically coupled to the resonator, and a backshort coupled to the substrate. Another embodiment features receiving an electromagnetic wave, collecting an incident portion of the received electromagnetic wave, generating first wave having a resonance at a predetermined frequency using the incident portion of the received electromagnetic wave, reflecting a portion of the received electromagnetic wave off of a reduced scale backshort, back towards a collector, generating a second wave having a resonance at a predetermined frequency using the reflected portion of the received electromagnetic wave, and combining the first wave and the second wave in phase.

13 Claims, 17 Drawing Sheets

900

1100

1500

APPARATUS AND METHOD FOR WAVEGUIDE TO MICROSTRIP TRANSITION HAVING A REDUCED SCALE BACKSHORT

CROSS-REFERENCE TO RELATED APPLICATION

This non-provisional application claims priority under 35 U.S.C. §119(e) of U.S. Provisional Application No. 60/672,009 filed Apr. 18, 2005, the entire contents thereof are relied upon and are expressly incorporated herein by reference.

BACKGROUND OF THE INVENTION

1. Field of the Invention

Embodiments of the present invention generally relate to Microwave Integrated Circuits (MIC) and monolithic devices, and more specifically, to transitions between waveguides and microstrips for devices operating in microwave and millimeter wave frequencies.

2. Description of the Background Art

Conventional techniques have been designed and developed to facilitate efficient transitions between waveguide and microstrip structures. These transitions may be used in a variety of integrated circuit devices which may operate in the RF, microwave, and millimeter wave frequency regimes. The transitions can effectively serve to act as a bridge between a front end of a system which transmits and receives electromagnetic (EM) waves, and the signal processing circuitry which may condition, exploit, and/or convert the EM waves into useful signals.

FIG. 15 depicts a conventional transition 1500 having a transition between a waveguide and a microstrip consistent with the conventional art. Device may include a open-ended waveguide 1510, a substrate 1512, a backshort 1514, a microstrip 1516, and a conductor pad 1518.

Open ended waveguide 1510, which has an opening having width A and height B, may either transmit or receive EM waves. The other end of open ended waveguide 1510 may be attached to substrate 1512. Substrate 1512 may have microstrip 1516 and conductor pad 1518 formed thereon. Backshort 1514 may be attached to substrate 1512 on an opposite side opposing open-ended waveguide 1510. As shown here, backshort 1514 can be a closed-ended waveguide having a length at least a quarter wavelength ($\lambda/4$) of the EM wave. For the conventional device, the long length of backshort 1514 is desired for proper operation of the conventional transition, which is described briefly below.

In one example, an incoming EM wave may be received at the open end of open-ended waveguide 1510, and propagate along its length toward substrate 1512. One portion of the EM wave incident at substrate 1512 may be collected by conductor pad 1518. Another portion of the incident EM wave may pass through substrate 1512 and be reflected off the closed end of backshort 1514. The reflected wave may travel back toward conductor pad 1518, and be collected thereon. Because the length of the conventional backshort 1512 may be $\lambda/4$ or longer, the reflected wave may combine in phase at conductor pad 1518 with the incident EM wave. The combine wave may then induce a current at conductor pad 1518 which may be conducted along microstrip 1516.

FIG. 16 depicts an equivalent circuit 1600 which may model conventional transition 1500 (of FIG. 15). A first sub-circuit 1610 models open-ended waveguide 1510, having a characteristic impedance Z1. A second sub-circuit 1616 models microstrip 1516, having a characteristic impedance Z2. It may be desirable to provide a matching circuit 1614 to connect each equivalent sub-circuit so that power transfer may be maximized. It also may also be desirable to optimize the parameters of open ended waveguide 1510 and microstrip 1516 to design matching circuit 1614, so that the EM energy input from open-ended waveguide 1510 is properly convened into microstrip 1516.

One potential issue with conventional transition 1500 is that it may be difficult to match the impedance between open-ended waveguide 1510 and microstrip 1516 given the large relative difference in the magnitude of their respective impedances. For example, the characteristic impedance of open ended waveguide 1510 for frequencies within the microwave region may usually be approximately 300-500 ohms, and the characteristic impedance of microstrip 1516 for the same frequencies may be 50 ohms. Given the differences in impedances, and the interaction of EM fields within the waveguides, it may be difficult to properly realize matching circuit 1614, which may utilize sophisticated three-dimensional circuit design.

Another potential issue with conventional transition 1500 may be the constraint that backshort 1514 has a considerable length which typically is greater than $\lambda/4$. This is driven by the desirability that backshort 1514 should appear as an "open circuit" from the viewpoint of a-a' as shown in FIG. 16. The backshort length becomes longer as the frequencies become lower, which may be a significant concern in devices when the frequencies are lower than 10 GHz.

Because the conventional techniques may result in devices having considerable size, they may be unsuitable for applications requiring portable operation. Additionally, conventional devices may be associated with higher cost and reduced reliability due to greater component complexity and increased component numbers.

SUMMARY OF THE INVENTION

Accordingly, embodiments of the present invention are directed to a transition between a waveguide and a microstrip which may reduce their scale and address the challenges associated with the related art.

In one embodiment of the invention, an apparatus providing a transition between a waveguide and a microstrip is presented. The apparatus features an open-ended waveguide having an exposed side at a distal end, a substrate coupled to the open-ended waveguide at a proximate end, a resonator coupled to the substrate, a microstrip line electromagnetically coupled to the resonator, and a backshort coupled to the substrate.

In another embodiment of the invention, a method for transitioning an electromagnetic signal between a waveguide and a microstrip is presented. The method features receiving an electromagnetic wave, collecting an incident portion of the received electromagnetic wave, generating first wave having a resonance at a predetermined frequency using the incident portion of the received electromagnetic wave, reflecting a portion of the received electromagnetic wave off of a reduced scale backshort, back towards a collector, generating a second wave having a resonance at a predetermined frequency using the reflected portion of the received electromagnetic wave, and combining the first wave and the second wave in phase.

Another embodiment of the invention presents an apparatus which provides a transition between a waveguide and a microstrip. The apparatus features an open-ended waveguide having an exposed side at a distal end, a substrate coupled to the open-ended waveguide at a proximate end, a conductor pad coupled to the substrate, a resonator coupled to the conductor pad, wherein the conductor pad joins the resonator offset from a center line of the resonator, and further wherein the resonator includes two slits, each slit being adjacent to the conductor pad, a microstrip line electromagnetically coupled to the resonator, and a closed-ended waveguide coupled to the substrate opposite to the open-ended waveguide.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION OF THE EMBODIMENTS

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Figure 1:
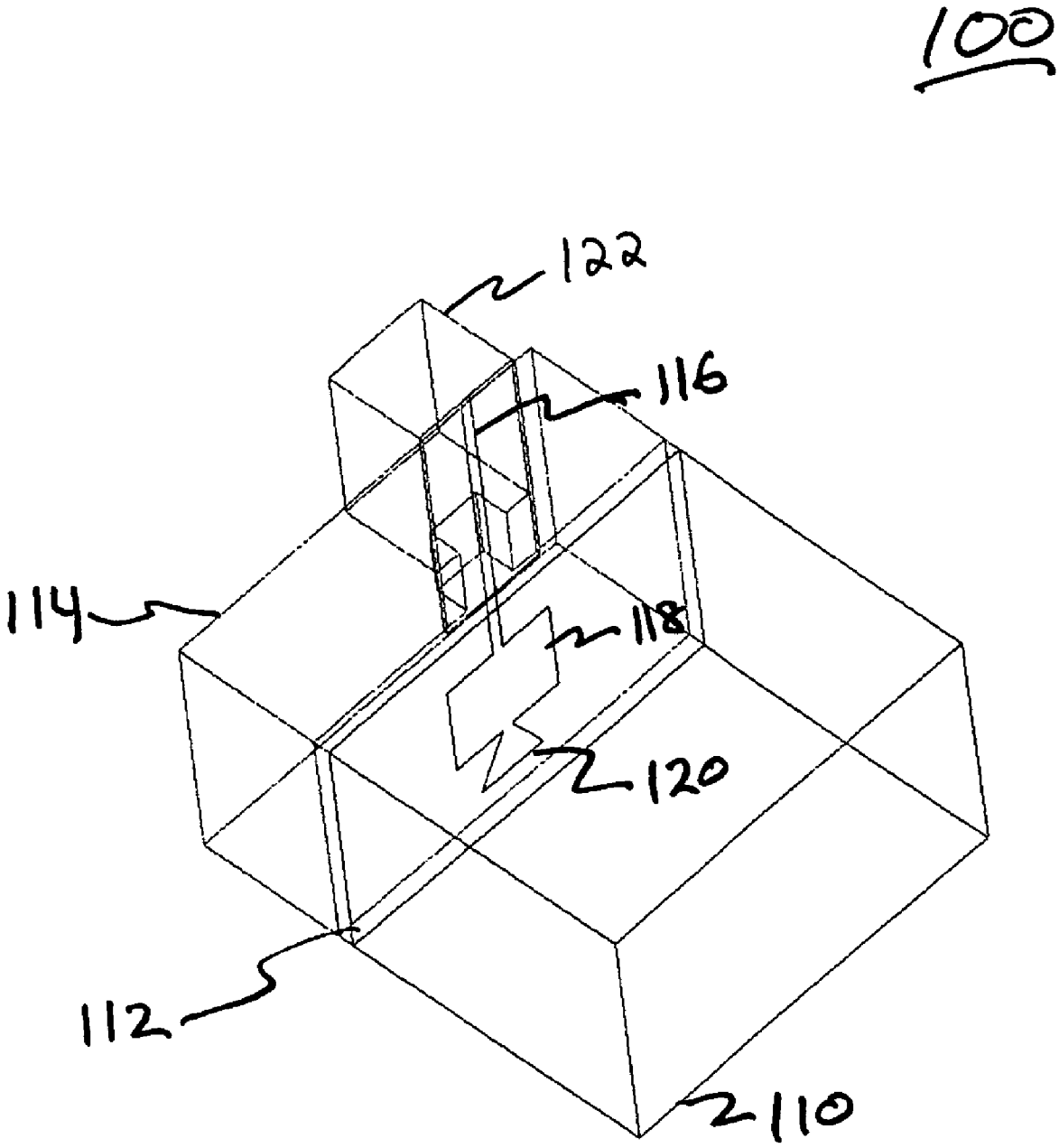
FIG. 1 shows a transition between a waveguide and a microstrip consistent with a first embodiment of the present invention.

FIG. 1 shows a first embodiment of a transition 100, passing electromagnetic (EM) waves between a waveguide and microstrip consistent with the present invention. Transition 100 includes an open-ended waveguide 110, a substrate 112, a backshort 114 having reduced scale, a microstrip 116, a resonator 118, and a conductor pad 120.

As used herein, the expression "reduced scale" may refer to a reduction is the size of the backshort 114 in any dimension; and includes reductions of size in the dimension of EM wave propagation. For example, reduced scale backshort 114 may include a backshort having a dimension in the direction of EM wave propagation which may be less than or equal to a quarter wavelength ($\lambda/4$) of the EM wave. It should be noted that the reduced scale backshort 114 dimensions may be arbitrary and are not limited only to integer fractions of a wavelength ($\lambda$).

Embodiments of the invention typically may utilize EM waves having frequencies in the microwave region. However, the EM waves are not restricted to microwave frequencies and may operate in other bands higher or lower than these frequencies. For example, embodiments may include EM waves having frequencies belonging to the RF frequency band.

Substrate 112 may be physically coupled to a side opposite the distal opening of open ended waveguide 110. Substrate 112 may also be physically coupled to backshort 114, on the opposite side of substrate 112 which is coupled to open ended waveguide 110. These physical couplings to substrate 112 and may be performed using adhesives, fasteners, any combination thereof, or any other method of joining such components known to one of ordinary in the art. Substrate 112 may be placed substantially perpendicularly to the openings of open ended waveguide 110 and backshort 114, so that substrate 112 is substantially perpendicular to the direction of EM wave propagation within open ended waveguide 110 and backshort 114. However other relative orientations of substrate 112, backshort 114, and open ended waveguide 110 may be contemplated by other embodiments of the invention. Substrate 112 may also be coupled to a supporting structure 122 which may be part of and/or lead to other devices, such as, for example, Microwave Integrated Circuits (MIC) which may perfonn processing operations and/or other fianctions on the EM waves and/or signals associated therewith.

Backshort 114 may have a reduced scale in the dimension of EM wave propagation, wherein the dimension is less than or equal to $\lambda/4$. Backshort 114 may be realized using waveguide of any shape, including rectangular, circular, or trapezoidal. Additionally, backshort 114 may be realized using printed circuit board material (PCB) having one or more layers, which could allow a small, thin backshort to be integrated with other circuitry in a MIC, and allow further reductions in device size. In one embodiment, a multi-layer PCB may form a backshort by having a step formed in one layer, wherein the step contains a layer appropriate for reflecting EM waves. The step layer could be formed with a metallic coating or other surface for causing EM wave reflection. Another layer could be formed over the backshort layer, and include conductor pad 120 and resonator 118. Backshorts formed using PCB may be realized using any technique know to one of ordinary skill in the art.

Open ended waveguide 110 may be any type of waveguide known in the art, and typically includes rectangular shaped waveguides, but may also include circular waveguides, trapezoidal waveguides, or any other waveguides known in the art. In one embodiment, open ended waveguide 110 may have rectangular shape with a width of approximately 22 mm and a height of 10 mm. Open ended waveguide 110 may have a length of approximately 25 mm.

In this embodiment, backshort 114 may have a length equal to or slightly less than $\lambda/4$ at 7.3 mm, and may have the same width and height of open ended waveguide 110.

Substrate 112 may include microstrip 116, resonator 118, and conductor pad 120 on the substrate surface facing the opening of open ended waveguide 110. Substrate 112 may be formed from any dielectric material known to one of ordinary skill in the art, and may include materials used in PCB fabrication, such as, for example, BT Resin or FR4 material. In one embodiment, the thickness of substrate 112 may be approximately 0.25 mm and may have a dielectric constant of 3.5.

Microstrip 116 may be oriented parallel to the field lines of the electric field of the EM wave, and may have a tap feed to resonator 118. As used herein, tap feed may refer to directly connecting the components so they may be electromagnetically coupled. In this embodiment, resonator 118 may have a tap feed to conductor pad 120. Microstrip 116 may be connected to other portions of a microwave circuit for further processing of signals associated with the EM wave. Microstrip 116, resonator 118, and conductor pad 120 may typically be formed from copper; however they could also be formed from aluminum or other materials known to one of ordinary skill in the art. Microstrip 116, resonator 118, and conductor pad 120 may be etched on the surface of substrate 112 which can be advantageous so that microstrip 116, resonator 118, conductor 120 pad, and substrate 112 may be made at same time during fabrication process.

Transition 100 may be used for either the transmission or reception of an EM wave. Provided below is a description of how an received EM wave propagates though transition 100. One of ordinary skill in the art would appreciate that transmission of an EM wave using transition 100 could occur in a manner reverse to reception of an EM wave due to reciprocity.

Initially, an EM wave may be received at the opening of open ended waveguide 110. The EM wave propagates down the waveguide and impinges on the surface of substrate 112 containing conductor pad 120. Conductor pad 120 collects an incident portion of the impinging EM wave and couples it to resonator 118. The remaining portion of the impinging electromagnetic wave passes through substrate 112 into backshort 114 (which will be discussed in more detail below). The collected portion is passed to resonator 118, where a first resonance is generated at a predetermined frequency using the energy received from the collected electromagnetic wave. The resonance frequency may be determined by the size and shape of resonator. The resonance frequency may also be altered by changing the thickness of the resonator 118, or by the choice of materials from which it is fabricated.

The portion of the impinging EM wave that passes through substrate 112, and is not initially collected by conductor pad 120, may pass into backshort 114 and reflect off of a closed end thereof. This reflected EM wave may propagate back towards collector 120. The reflected EM wave may then also be passed to resonator 118 to produce a second resonance wave having the same frequency as the first resonance wave described above. The first and second resonance waves may combine, and then the combination EM wave is passed onto microstrip 116. From microstrip 116, the combined EM wave may be further processed by signal processing circuitry, such as, for example, microwave integrated circuits.

Figure 2:
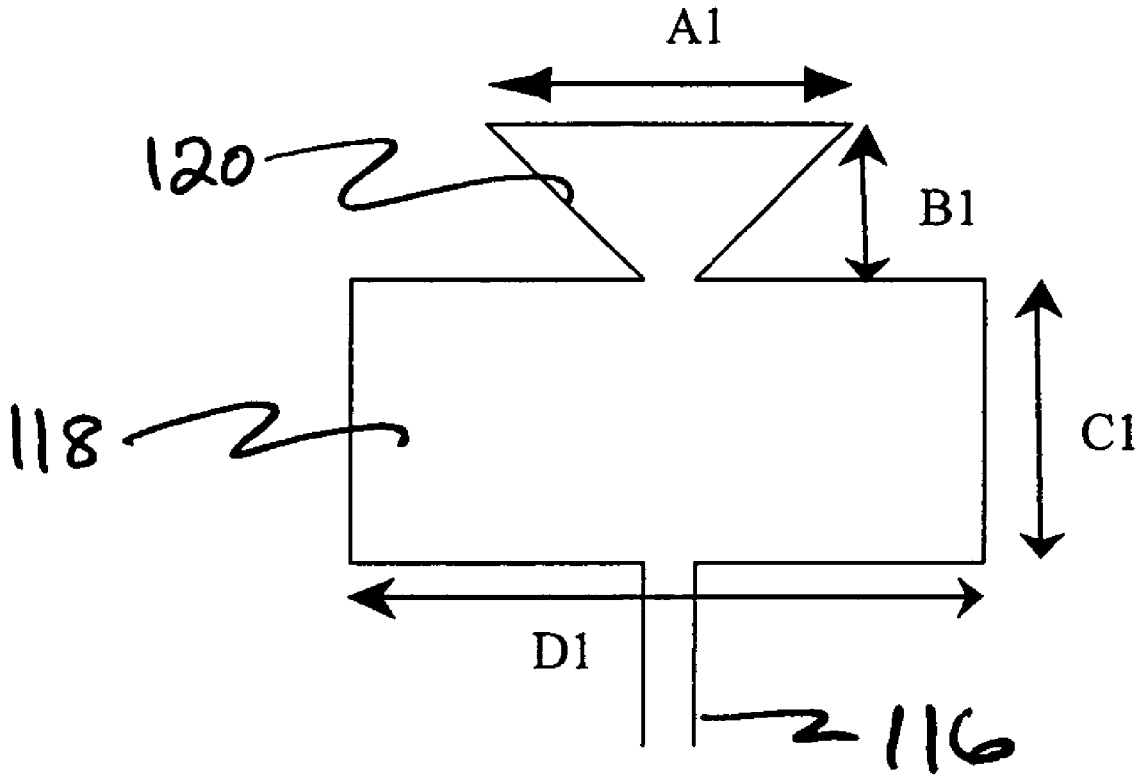
FIG. 2 depicts an exemplary resonator, conductor pad, and microstrip consistent with the first embodiment of the invention.

FIG. 2 depicts a detailed view of an exemplary resonator 118, conductor pad 120, and microstrip 116 consistent with the first embodiment of the invention.

In this embodiment, microstrip 116 is patterned on substrate 112(see FIG. 1) having a tap feed to resonator 118. Resonator 118 may have a height of C1 and a width of D1. Conductor pad 120 may have a tap feed to resonator 118 and have a maximum width of A1, and a height of B1. One of ordinary skill in the art would appreciate that conductor pad 120 and resonator 118 may be electromagnetically coupled in ways other than using a tap feed. For example, as shown in other embodiments below, these components may be inductively coupled. The values of C1 and D1 may, in part, determine the resonance frequency of resonator 118. The values of A1 and B1 determine how much energy is coupled into resonator 118 and may, in part, determine how efficiently energy is coupled into resonator 118. For example, in order to produce the simulated frequency characteristics, as shown, for example, on the graphs in FIG. 3, resonator 118 dimensions may be C1=4 mm (Height) and D1=8 mm (Width). Conductor pad 120 may have the dimensions A1=4 mm and B1=2.08 mm.

Figure 17:
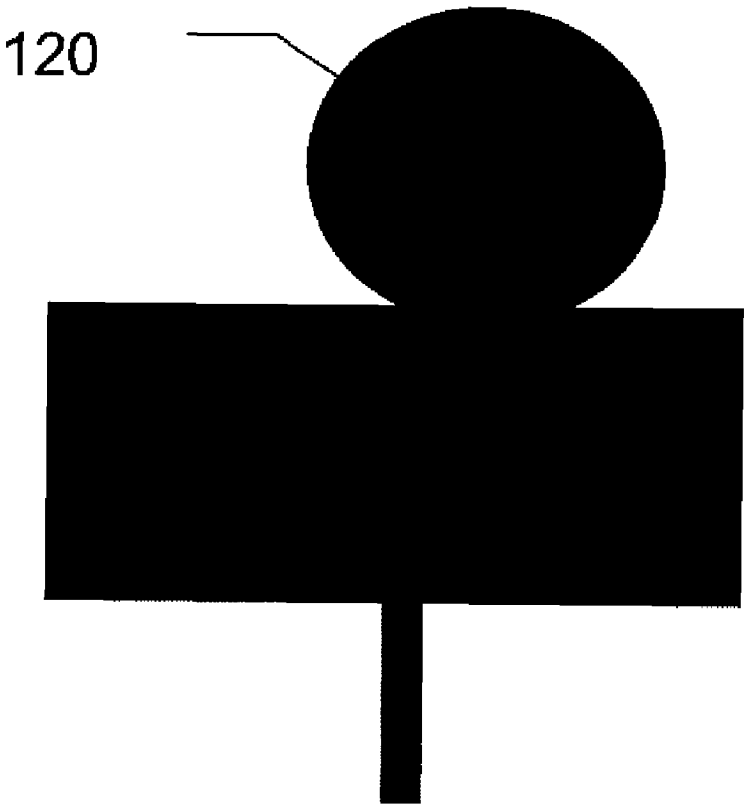
FIG. 17 shows an embodiment of a circular-shaped conductor pad according to the present invention.

Conductor pad 120 may essentially act like an antenna, which converts EM wave energy into an electric current. The shape of conductor pad 120 may be triangular, circular (as shown in FIG. 17), elliptical, etc. The size and shape of the pad may determine the efficiency of the conversion from EM wave energy to electrical current.

Resonator 118 may be positioned and/or oriented in open ended waveguide 110 so that it is not coupled with waveguide. That is, the substantial portion of EM wave energy propagating through waveguide 110 does couple into resonator 118 directly, but is collected by conductor pad 120 and then passed onto resonator 118.

Figure 3:
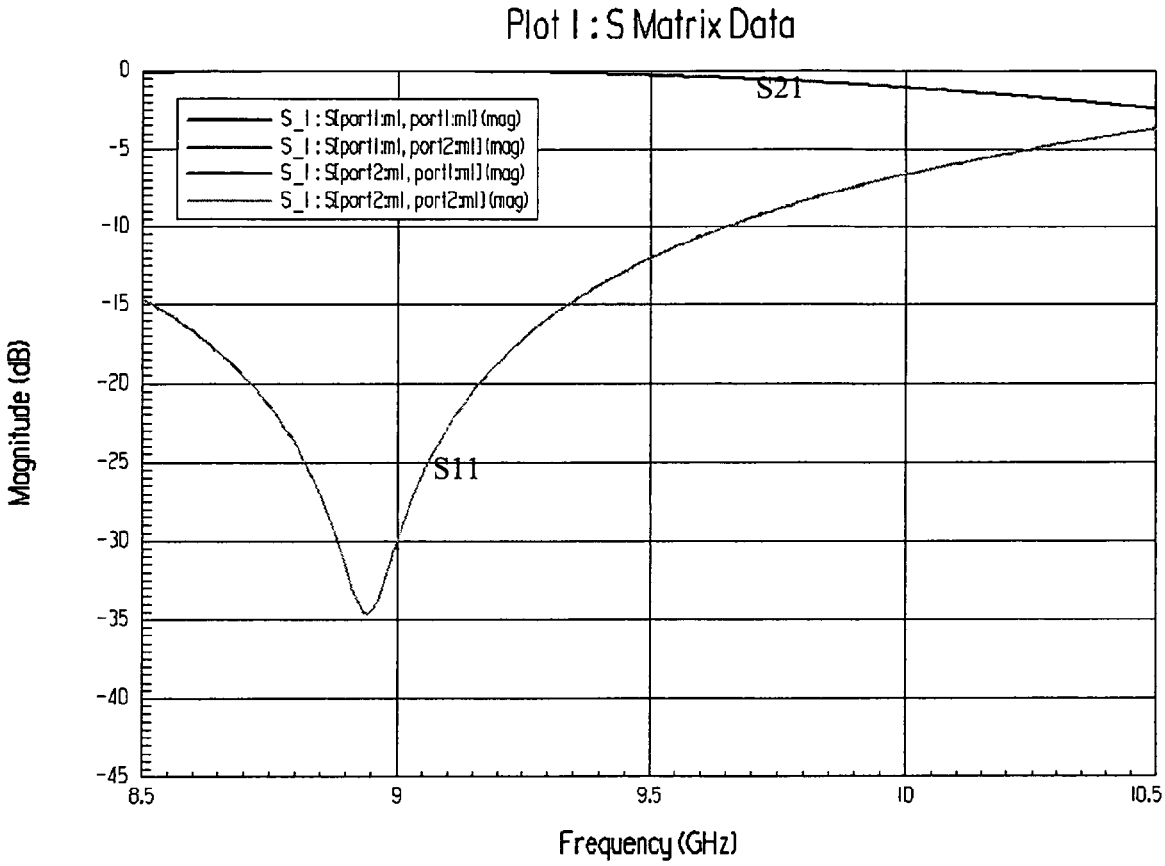
FIG. 3 shows the results of an exemplary simulation estimating the frequency performance associated with the first embodiment of the invention.

FIG. 3 shows the results of an exemplary simulation estimating the frequency performance associated with the first embodiment of the invention. The simulation results presented herein may be produced by a three dimensional EM simulation, which are well known in the art, an example of which can be a program called "HFF" produced by Ansoft.

The graph shown in FIG. 3 shows the magnitude of the impedance associated with parameters of a scattering matrix, S11 and S21, as a function of frequency. S11 may be associated with the magnitude of a reflecting EM wave, and S21 may be associated with the magnitude of a EM wave passing through transition 100. In the graph shown, the frequency response is shown over a microwave region of 8.5 to 10.5 GHz, but other frequency regions may be shown if desired. S11 and S21 represent values that can be measured between the edge of open-ended waveguide 110 and the edge of microstrip 116.

As can be seen from FIG. 3, the curve simulating the magnitude S11 shows a considerable "dip" around 9 GHz, meaning EM energy associated with desirable frequencies tends to not be reflected. As shown here, reflections are attenuated approximately −35 dB around 9 GHz. The curve simulated the magnitude S21 shows frequencies being passed in the 9 GHz region, and energy associated with undesirable frequencies above around 10 GHz are attenuated.

Figure 4:
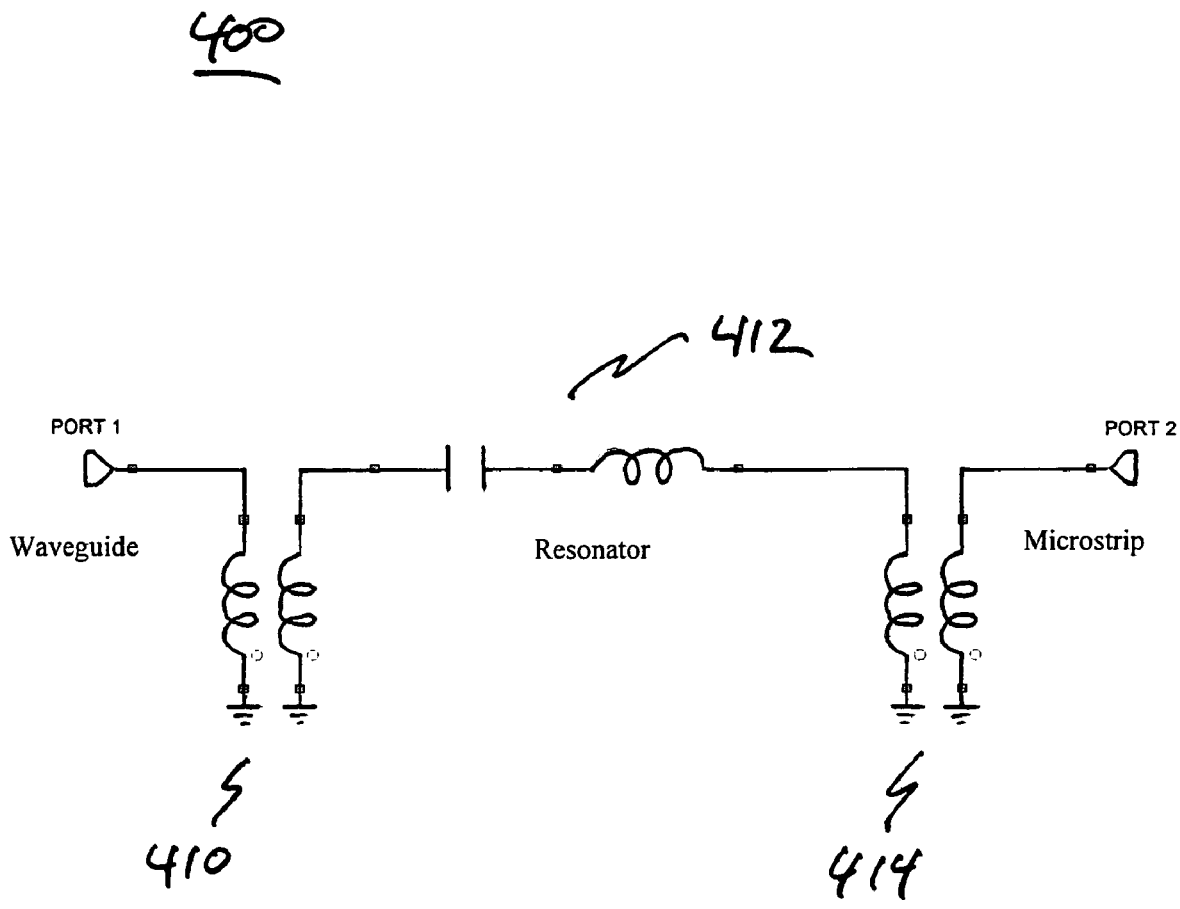
FIG. 4 shows an equivalent circuit model associated with the first embodiment of the invention.

FIG. 4 shows an equivalent circuit model 400 associated with the first embodiment of the invention. This equivalent circuit may be used to predict the frequency response and produce the S11 and S21 curves shown in FIG. 3. Port 1 represents open ended waveguide 110, which is electromagnetically coupled to resonator 118 via conductor pad 120. This coupling between open ended waveguide 110 and conductor pad 120 is modeled by first inductor pair 410. Each inductor in first inductor pair 410 may have an inductance value of $L=1*10^{-9}$ Henries and a resistance value of 0 Ohms. First inductor pair 410 may modeled as being physically connected with equivalent resonator 412. Equivalent resonator 412 is coupled in series with second inductor pair 414, which models the tap feed coupling between resonator 118 and microstrip 116. Second inductor pair 414 may have inductors having an inductance of $1*10^{-2}$ Henries and a resistance value of 0 Ohms. Finally, port 2 is designated as microstrip 116 in equivalent circuit 400.

Figure 5:
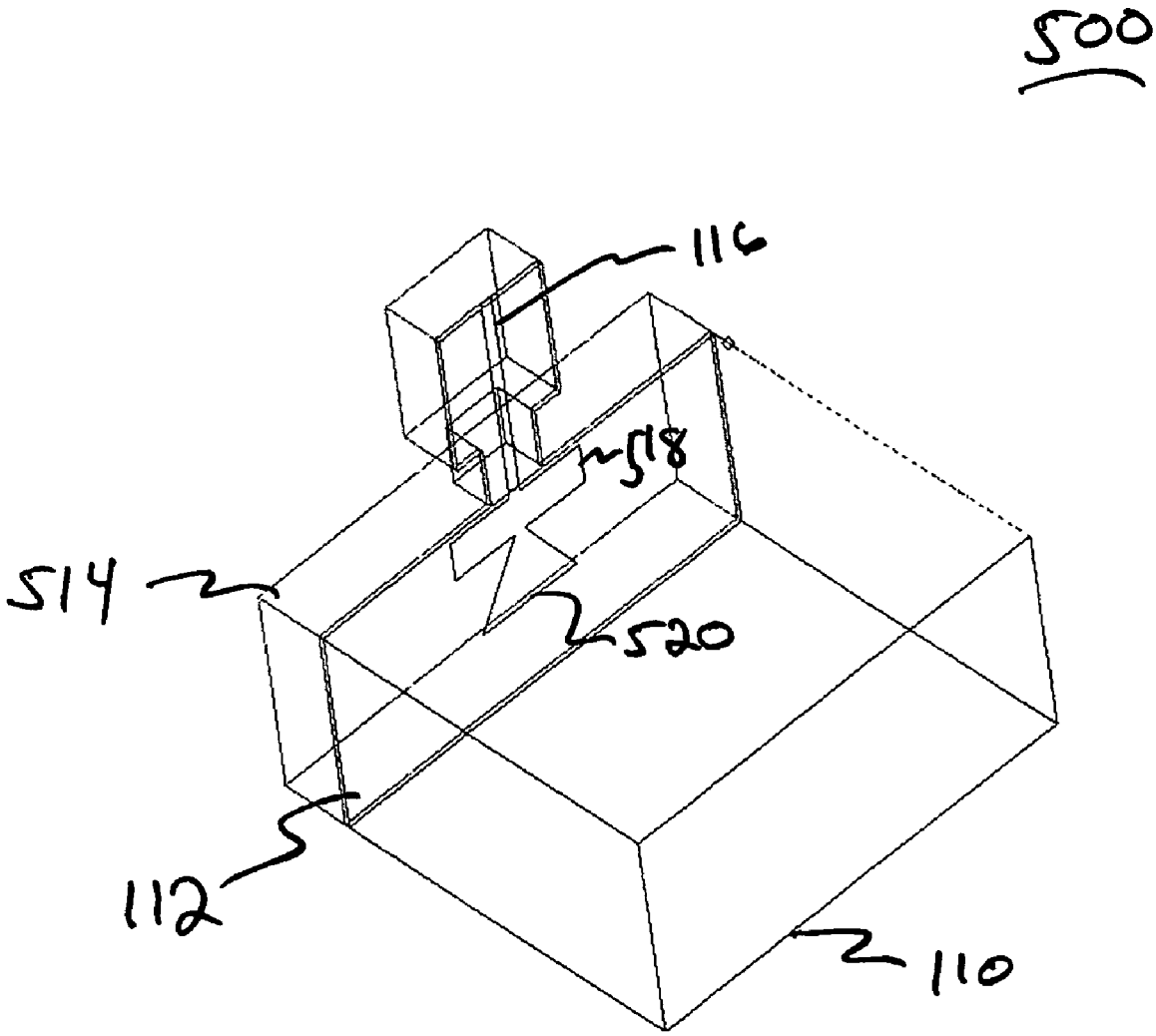
FIG. 5 depicts a transition between a waveguide and microstrip consistent with a second embodiment of the present invention.

FIG. 5 depicts a second embodiment 500 of a transition between a waveguide and microstrip consistent with the present invention. Transition 500 includes a backshort 514, a resonator 518, and a conductor pad 520. Elements which may be common to the first embodiment are shown but are not listed here for the sake of brevity.

In this embodiment, backshort 514 may have a length in the direction of EM wave propagation of $\lambda/8$, which is almost half the size of the first embodiment. The compact size may be achieved by altering the size of the modification of resonator pad 518. Conductor pad 520 may also have a modified size in order to effectively match the power transfer of the EM wave received through waveguide l10 into resonator 518. Resonator 518 may have a narrower height and width than resonator 118 shown in the first embodiment.

Figure 6:
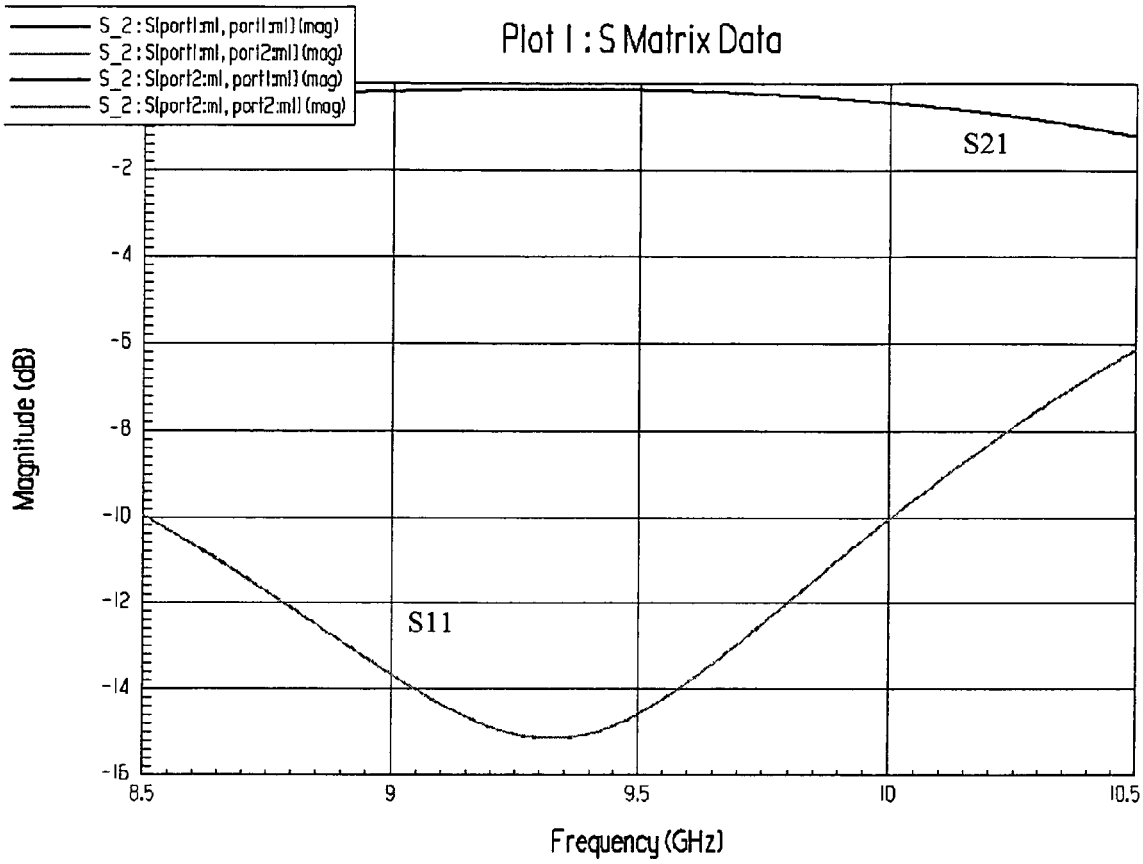
FIG. 6 shows the results of an exemplary simulation estimating the frequency performance associated with the second embodiment of the invention.

FIG. 6 shows the results of an exemplary simulation estimating the frequency performance associated with the second embodiment of the invention shown in FIG. 5. This graph shows the magnitude of the impedance associated with parameters of a scattering matrix, S11 and S21, over a frequency range of 8.5 GHz to 10.5 GHz. S11 may be associated with the magnitude of a reflecting EM wave, and S21 may be associated with the magnitude of a EM wave passing through transition 500. As before, S11 and S21 represent values that can be measured between the edge of open-ended waveguide 110 and the edge of microstrip 116.

As can be seen from FIG. 6, the curve simulating the magnitude S11 shows a "dip" around 9 GHz where EM energy associated with desirable frequencies tends to not be reflected. In this embodiment, reflections may be attenuated approximately −15 dB around 9 GHz. While this attenuation level may be less than that shown in FIG. 3, it may be sufficient for applications where transition 500 can be used. The curve simulated the magnitude S21 shows frequencies being passed in the 9 GHz region, and energy associated with undesirable frequencies above around 10 GHz are attenuated.

Figure 7:
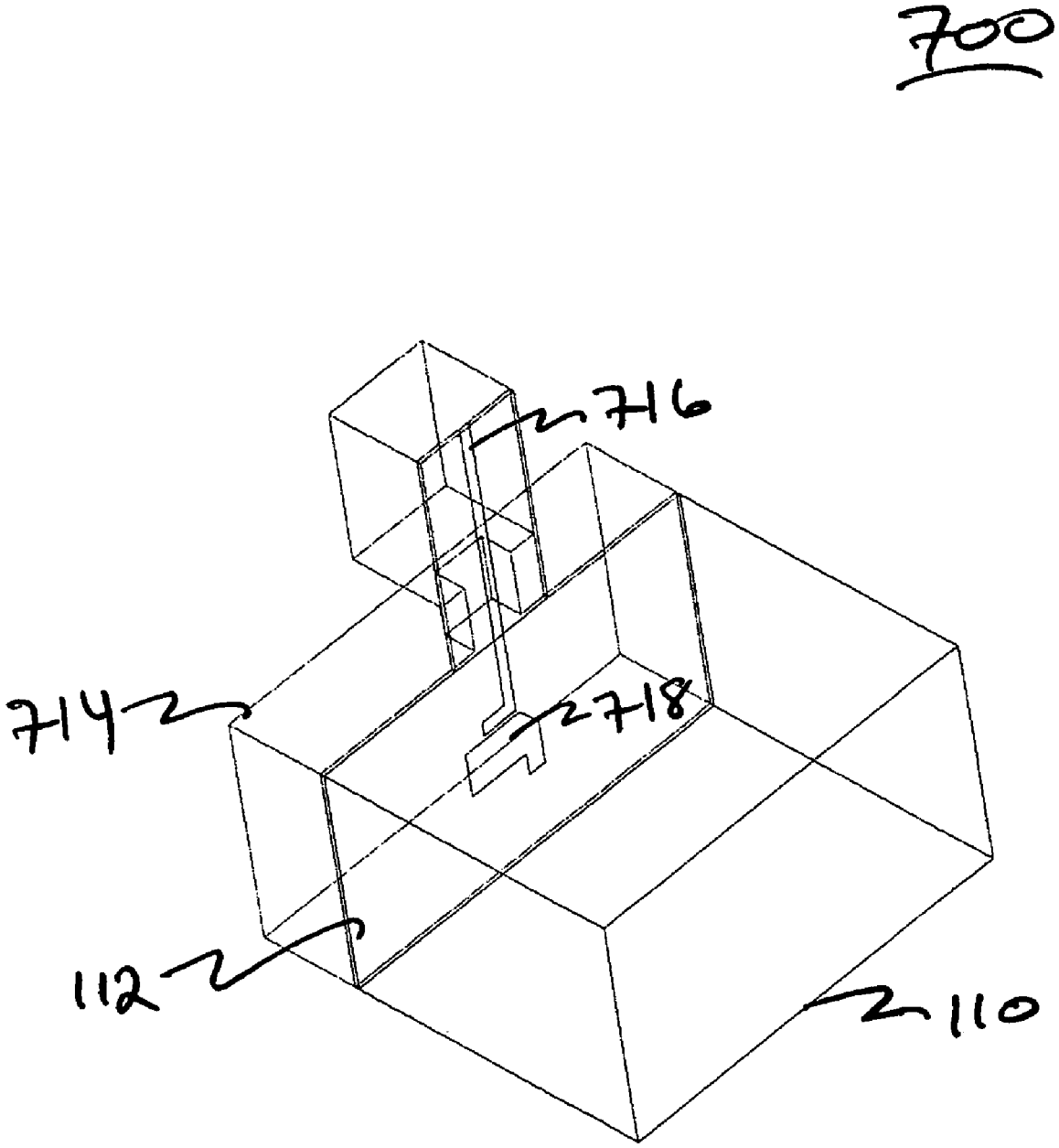
FIG. 7 depicts a transition between a waveguide and microstrip consistent with a third embodiment of the present invention.

FIG. 7 depicts a third embodiment of a transition 700 between a waveguide and microstrip consistent with the present invention. Transition 700 includes a backshort 714, a microstrip 716, and a resonator 718. Elements which may be common to the first embodiment are shown but are not listed here for the sake of brevity. Transition 700 may avoid having a conductor pad on substrate 112 by altering the structure of microstrip 716 and resonator 718. In the prior embodiments, a tap feed may be used to couple the resonator and the microstrip. Transition 700 features an electromagnetic coupling between microstrip 716 and resonator 718, so there may be no direct physical connection between them.

Figure 8:
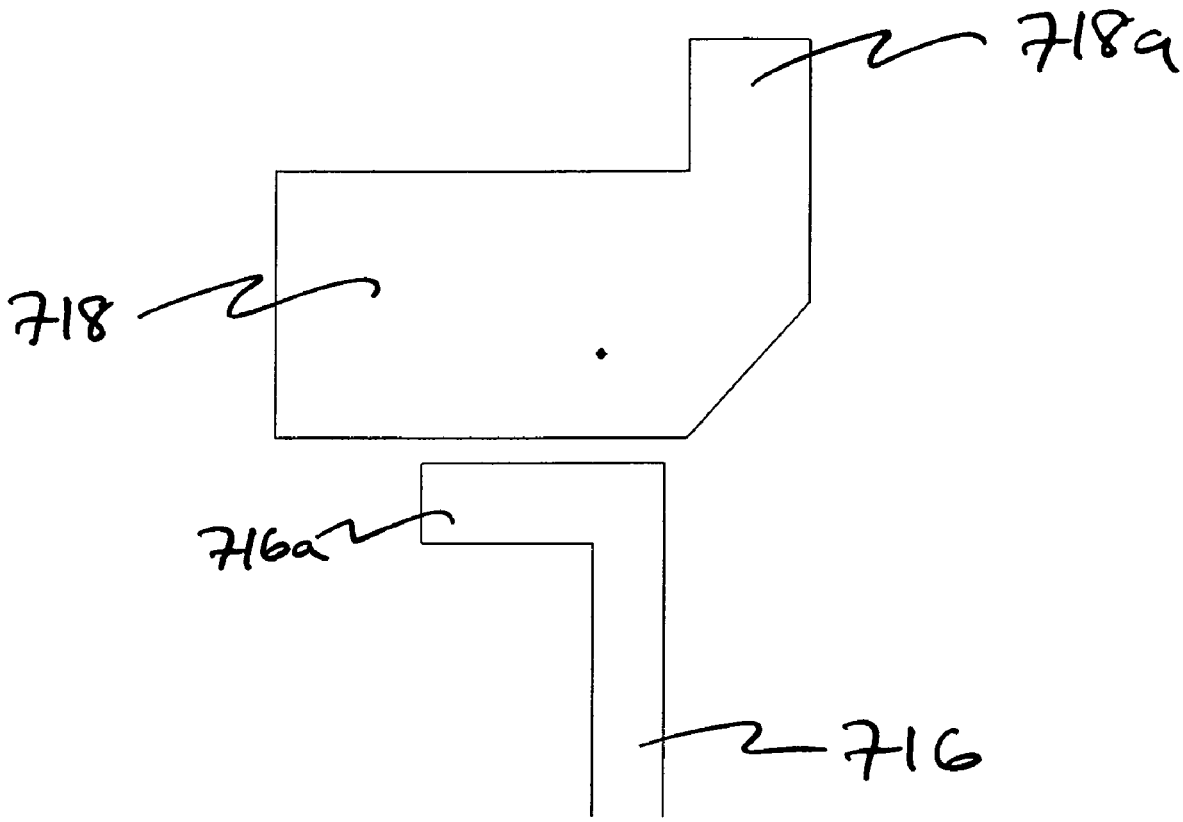
FIG. 8 shows an exemplary resonator and microstrip associated with the third embodiment.

FIG. 8 shows the detail an exemplary resonator 718 and microstrip 716 associated with the third embodiment 700. Resonator 718 may have a probe 718*a* directly coupled to it. Microstrip 716 may have an inductive coupling 716*a* directly attached to it, which is proximate to resonator 718. Inductive coupling 716*a* may be proximately placed to resonator 718, and may be oriented to maximized the electromagnetic coupling between resonator 718. Both probe 718*a* and inductive coupling 716*a* may be configured to act as conductor pads to collect energy from EM waves.

Figure 9:
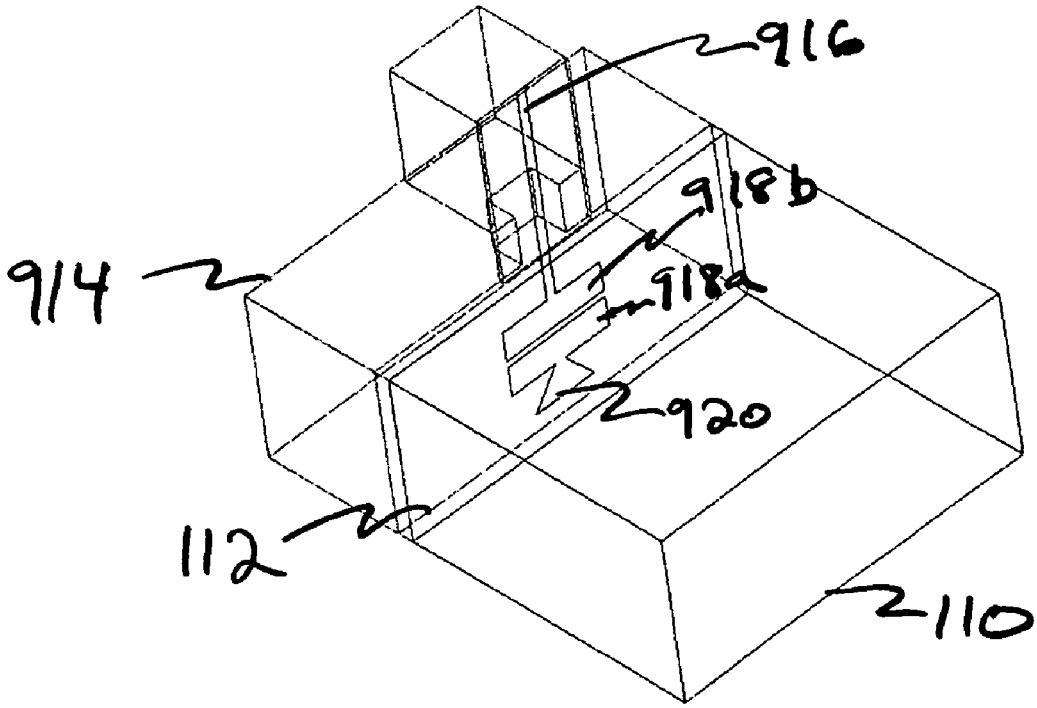
FIG. 9 depicts a transition between a waveguide and microstrip consistent with a fourth embodiment of the present invention.

FIG. 9 depicts a fourth embodiment of a transition 900 between a waveguide and microstrip consistent with the present invention. Transition 900 includes a backshort 914, a microstrip 916, a first resonator 918*a*, a second resonator 918*b*, and a collector 920. Elements which may be common to the first embodiment are shown but are not listed here for the sake of brevity.

Transition 900 includes a pair of resonators which may not be directly coupled, but are instead coupled electromagnetically. Conductor pad 920 is coupled by a tap feed to first resonator 918*a*. First resonator 918*a* may be electromagnetically coupled to second resonator 918*b*. Second resonator 918*b* may be coupled by a tap feed to microstrip 916. In this embodiment, the two resonators can behave as a two resonator filter.

In transition 900, resonators 918*a* and 918*b* may be etched on the same side of substrate 112. Alternatively, each resonator may be coupled on opposites of a single layered substrate 112. The size of conductor pad may be altered to maximize the energy coupled to first resonator 918*a*.

Figure 10:
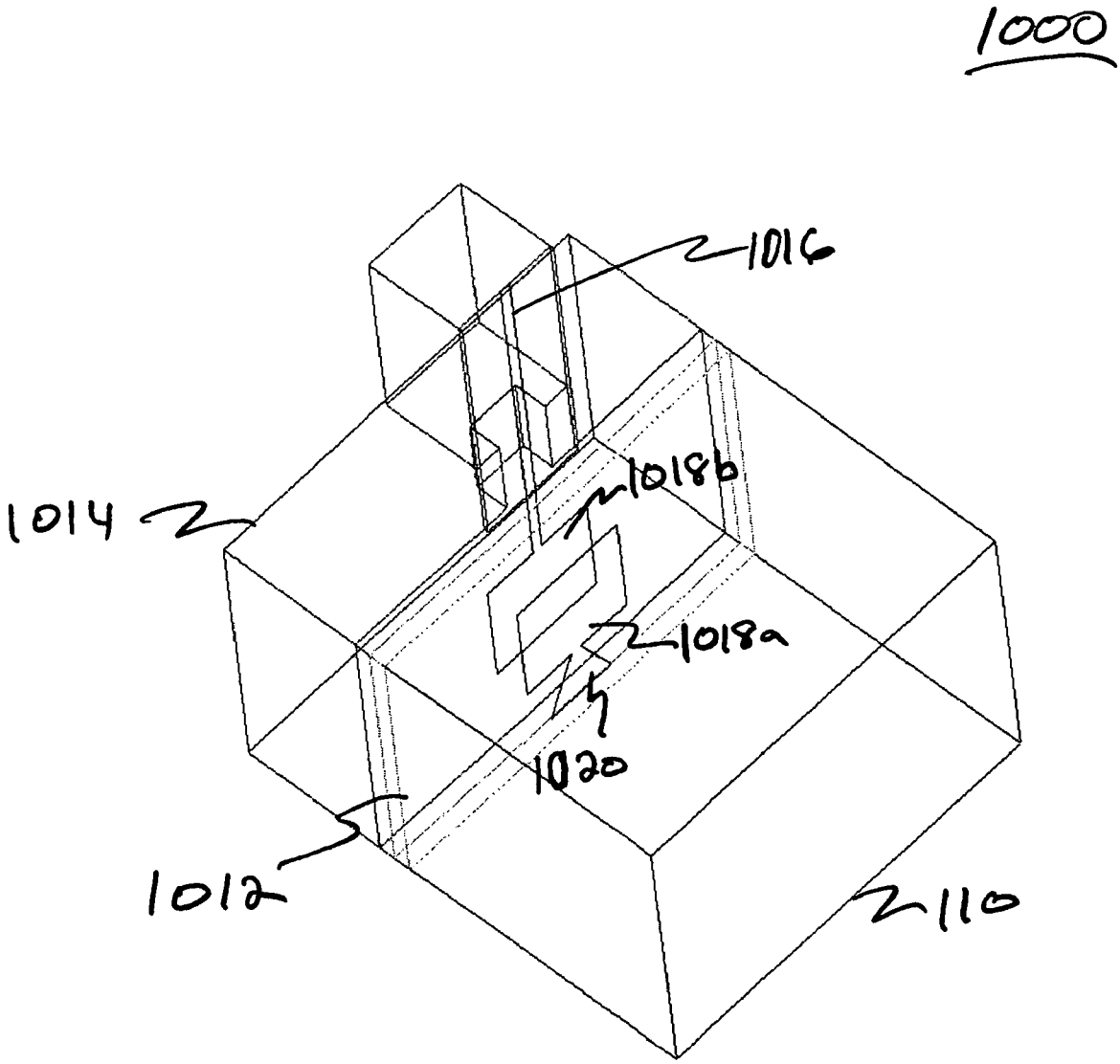
FIG. 10 depicts a transition between a waveguide and microstrip consistent with a fifth embodiment of the present invention.

FIG. 10 depicts a fourth embodiment of a transition 1000 between a waveguide and microstrip consistent with the present invention. Transition 1000 includes a multi-layered substrate 1012, a backshort 1014, a microstrip 1016, a first resonator 1018*a*, a second resonator 1018*b*, and a collector 1020. Elements which may be common to the first embodiment are shown but are not listed here for the sake of brevity.

Transition 1000 includes a pair of resonators which may not be directly coupled, but may be instead coupled electromagnetically. Conductor pad 1020 may be coupled by a tap feed to first resonator 1018*a*. First resonator 1018*a* may be electromagnetically coupled to second resonator 1018*b*. Second resonator 1018*b* may be coupled by a tap feed to microstrip 1016. In this embodiment, the two resonators 1018*a* and 1018*b* can behave as a two resonator filter.

In transition 1000, resonators 1018*a* and 1018*b* may be associated with different layers of multi-layer substrate 1012. First resonator 1018*a* and conductor pad 1020 may be etched on the side of multi-layer substrate 1012 closest to the opening of open ended waveguide 110. Second resonator 1018*b* and microstrip 1016 may be etched on the side of multi-layered substrate 1012 closest to backshort 1014.

Figure 11:
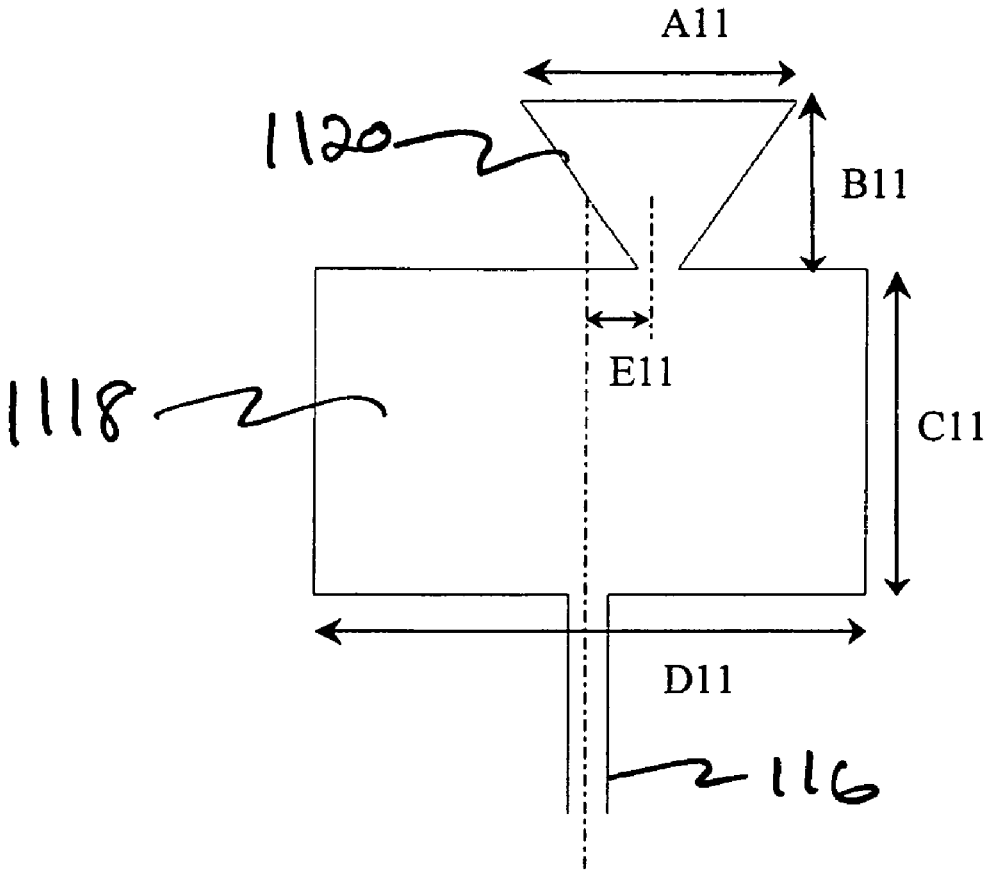
FIG. 11 shows an exemplary resonator and conductor pad associated with a sixth embodiment of the invention.

FIG. 11 shows a sixth embodiment 1100 which includes a resonator 1118 and an offset conductor pad 1120. In this embodiment, offset conductor pad 1120 is directly coupled to resonator 1118 at a location off-center from the center line of resonator 1118. Specifically, offset conductor pad 1120 maybe shifted in the horizontal dimension of the resonator 1118 by an small amount. Resonator 1118 may have, for example, a width D11 of 8 mm and a height C11 of 4mm. Offset conductor pad 1120 may have a maximum width A11 of 4 mm and a height B11 of 2.08 mm. The offset location E11 of offset conductor pad 1120 may be 1 mm from the center line of resonator 1118. This structure may have the advantage of reducing the reflection levels at the low end of the frequency band, but also cut undesirable frequencies at the upper edge of the frequency band, which is described in more detail below.

Figure 12:
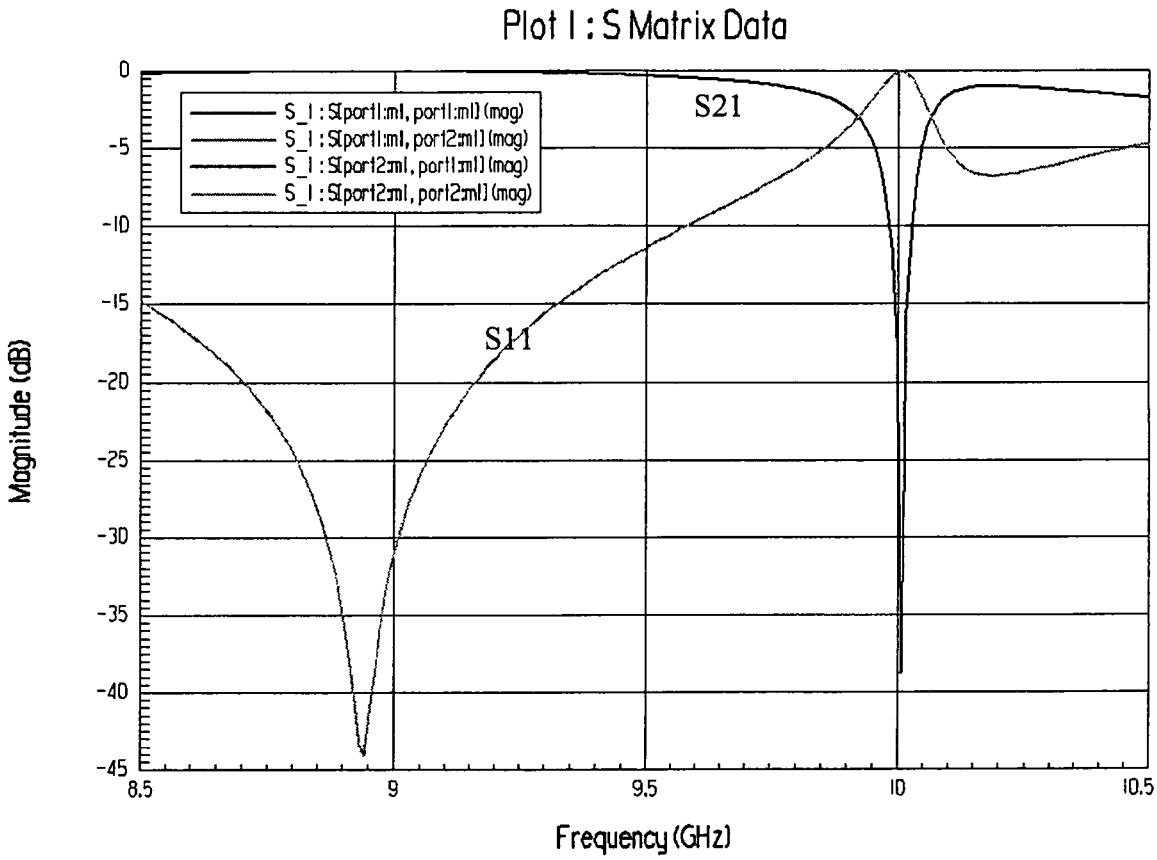
FIG. 12 shows the results of an exemplary simulation estimating the frequency performance associated with the sixth embodiment of the invention.

FIG. 12 shows the results of an exemplary simulation estimating the frequency performance associated with the sixth embodiment of the invention. This graph shows the magnitude of the impedance associated with parameters of a scattering matrix, S11 and S21, over a frequency range of 8.5 GHz to 10.5 GHz. S11 may be associated with the magnitude of a reflecting EM wave, and S21 may be associated with the magnitude of a EM wave passing through transition 1000. As before, S11 and S21 represent values that can be measured between the edge of open-ended waveguide 110 and the edge of microstrip 116. Elements which may be common to the first embodiment are shown but not listed here for the sake of brevity.

As can be seen from FIG. 12, the curve simulating the magnitude S11 shows a steep "dip" around 9 GHz where EM energy associated with desirable frequencies tend to not be reflected. This embodiment has the advantage of not only attenuating reflections by approximately a steep −45 dB around 9 GHz, but also reflects undesirable frequencies as shown by the "bump" is S11 at 10 GHz. The curve simulated the magnitude S21 shows frequencies being passed in the 9 GHz region, and energy associated with undesirable frequencies above around 10 GHz are sharply attenuated by approximately −40 dB.

Figure 13A:
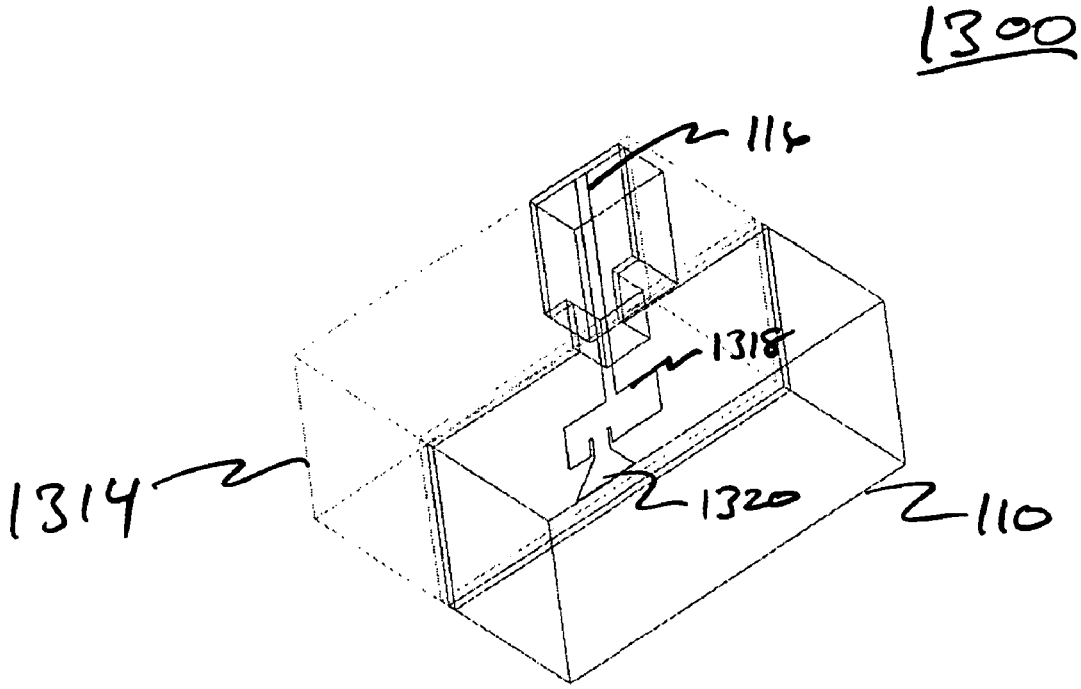
FIG. 13A shows a transition between a waveguide and microstrip consistent with a seventh embodiment of the present invention.

FIG. 13A shows a seventh embodiment of a transition 1300 between a microstrip and a waveguide consistent with the present invention. Transition 1300 includes backshort 1314, a resonator 1318, and an offset conductor pad 1320. In this embodiment, offset conductor pad 1320 is directly coupled to resonator 1318 at a location off-center from the center line of resonator 1318. As in the previous embodiment, offset conductor pad 1320 may be shifted in the horizontal dimension of the resonator 1318 by an small amount. Elements which may be common to the first embodiment are shown but not listed here for the sake of brevity.

Figure 13B:
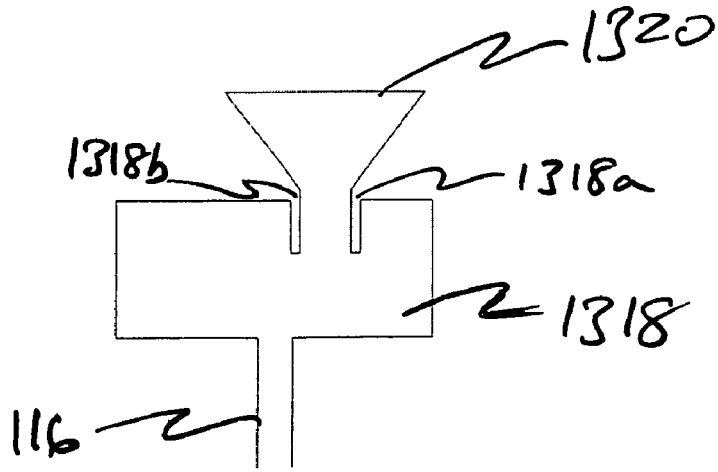
FIG. 13B shows a resonator with having slits and a conductor pad associated with the seventh embodiment of the present invention
Figure 14:
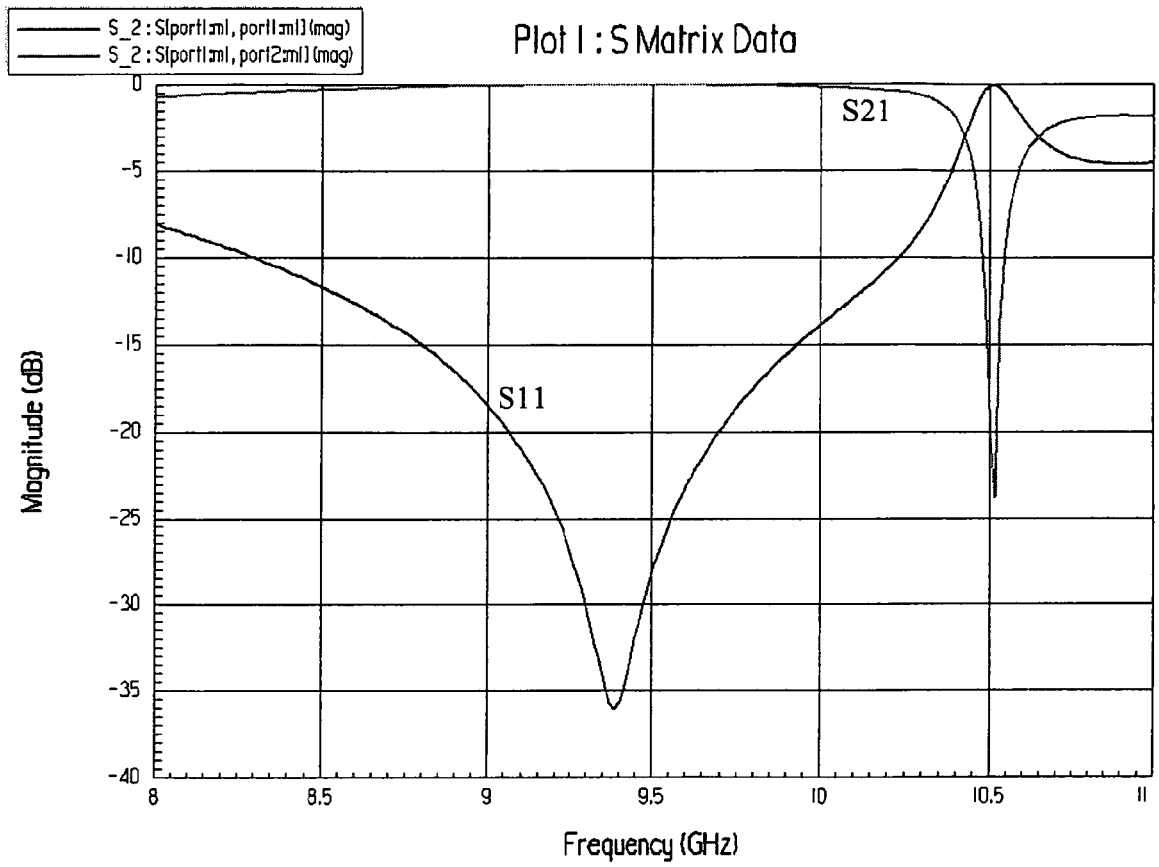
FIG. 14 depicts the results of an exemplary simulation estimating the frequency performance associated with the seventh embodiment of the invention.
Figure 15:
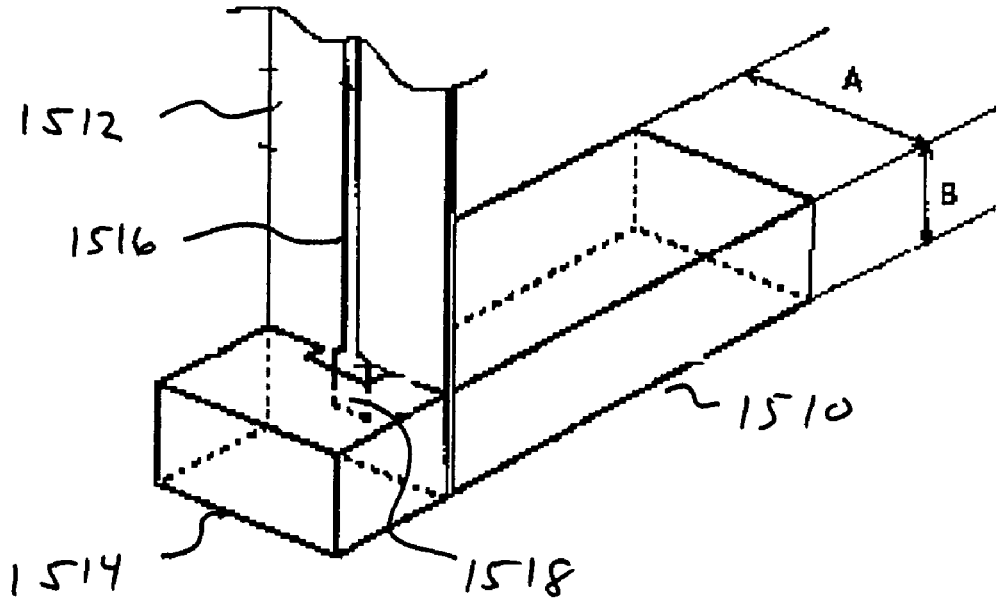
FIG. 15 depicts a conventional transition between a waveguide and a microstrip consistent with the conventional art.
Figure 16:
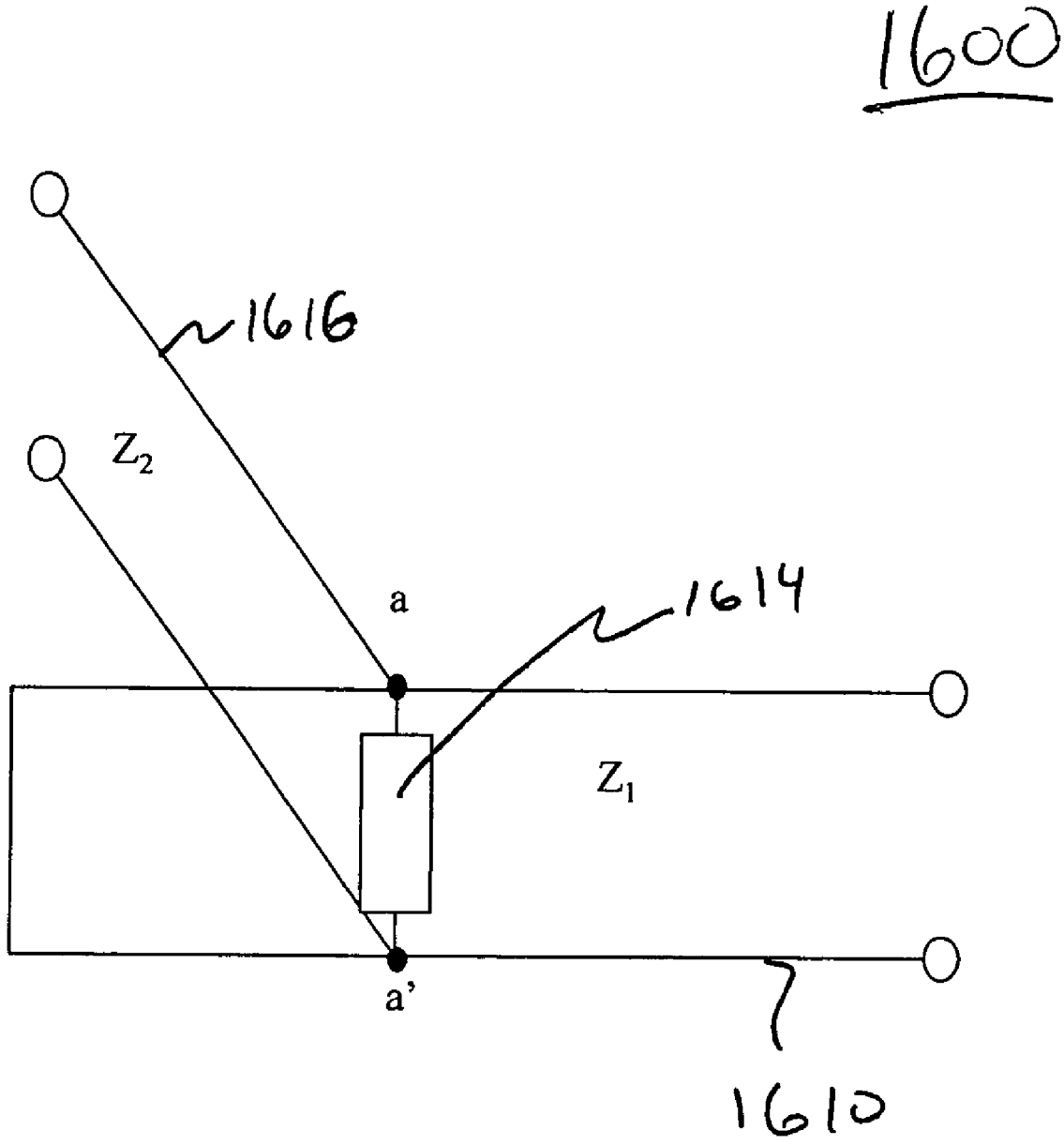
FIG. 16 shows an equivalent circuit modeling the device shown in FIG. 15.

As shown in FIG. 13B, resonator 1318 may have two slits cut into its edge where it meets offset conductor pad 1320. First slit 1318*a* may be on one side of the offset conductor pad 1320, and second slit 1318*b* may be on the other side of offset conductor pad 1320. Elements which may be common to the first embodiment are shown but not listed here for the sake of brevity. This structure may alter the frequency characteristics of transition 1300 by shifting the cutoff points in frequency as shown in FIG. 14 described below, and maintaining the advantage of reducing the reflection levels at the low end of the frequency band, and also cutting undesirable frequencies at the upper edge of the frequency band. FIG. 14 describes the frequency response of curves S11 and S21 in more detail below.

FIG. 14 depicts the results of an exemplary simulation estimating the frequency performance associated with the seventh embodiment of the invention. Here, the modification shown in resonator 1318 allows the alteration of the magnitude curves S11 and S21. As before, S11 and S21 represent values that can be measured between the edge of open-ended waveguide 110 and the edge of microstrip 116.

As can be seen from FIG. 14, the frequency response curves have been altered by the slits 1318*a* and 1318*b* placed into resonator 1318. The curve simulating the magnitude S11 has kept its magnitude attenuating characteristics, but has shifted the "dip" from around 9 GHz to around 9.5 GHz, wherein EM energy associated with these frequencies tend to not be reflected. This embodiment also the advantage of reflecting undesirable frequencies as shown by the "bump" is S11, which has been shifted to 10.5 GHz. The curve simulated the magnitude S21 also shows the effect of slits 1318*a* and 1318*b* in resonator 1318, showing frequencies being passed in the 9.5 GHz region, and energy associated with undesirable frequencies above around 10.5 GHz being sharply attenuated by approximately −25 dB.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus which provides a transition between a waveguide and a microstrip, comprising:

an open ended waveguide having an exposed side at a distal end;

a substrate coupled to the open ended waveguide at a proximate end;

a conductor pad coupled to the substrate;

a resonator coupled to the conductor pad, wherein the conductor pad joins the resonator offset from a center line of the resonator, and further wherein the resonator includes two slits, each slit being adjacent to the conductor pad;

a microstrip line electromagnetically coupled to the resonator; and a closed-ended waveguide coupled to the substrate opposite to the open ended waveguide.

2. The apparatus according to claim 1, wherein the closed ended waveguide comprises a backshort with a reduced scale, having a dimension in a direction of propagation of an electromagnetic wave of an arbitrary fraction of a wavelength.

3. The apparatus according to claim 1, wherein the microstrip is arranged substantially perpendicular to a direction of propagation of an electromagnetic wave in the open-ended waveguide.

4. The apparatus according to claim 1, wherein the conductor pad is polygonal or circular in shape.

5. The apparatus according to claim 1, wherein the closed ended waveguide comprises a backshort with a reduced scale, having a dimension in a direction of propagation of an electromagnetic wave of less than λ4.

6. An apparatus providing a transition between a waveguide and a microstrip, comprising:

an open ended waveguide having an exposed side at a distal end;

a substrate coupled to the open ended waveguide at a proximate end;

a resonator coupled to the substrate;

a microstrip line electromagnetically coupled to the resonator;

a backshort coupled to the substrate opposite the distal end of the open ended waveguide; and a conductor pad associated with the substrate and electromagnetically coupled to the resonator, wherein the resonator includes two slits, each slit being adjacent to the conductor pad.

7. An apparatus providing a transition between a waveguide and a microstrip, comprising:

an open ended waveguide having an exposed side at a distal end;

a substrate coupled to the open ended waveguide at a proximate end;

a resonator coupled to the substrate;

a microstrip line electromagnetically coupled to the resonator; and a backshort coupled to the substrate opposite the distal end of the open ended waveguide, wherein the backshort comprises a closed ended waveguide having a reduced scale, with a dimension in a direction of propagation of an electromagnetic wave of less than λ4.

8. A method for transitioning an electromagnetic signal between a waveguide and a microstrip, comprising:

receiving an electromagnetic wave;

collecting an incident portion of the received electromagnetic wave with a conductor pad;

generating, with a resonator, a first wave having a resonance at a predetermined frequency using the incident portion of the received electromagnetic wave;

reflecting a portion of the received electromagnetic wave off of a reduced scale backshort, back towards a collector;

generating with said resonator, a second wave having a resonance at a predetermined frequency using the reflected portion of the received electromagnetic wave; and combining the first wave and the second wave, wherein the conductor pad and the resonator are electromagnetically coupled and associated with a substrate, the conductor pad contacts the resonator offset from a center line of the resonator, and the resonator includes two slits, each slit being adjacent to the conductor pad.

9. An apparatus providing a transition between a waveguide and a microstrip, comprising:

an open ended waveguide having an exposed side at a distal end;

a substrate coupled to the open ended waveguide at a proximate end;

a resonator coupled to the substrate;

a microstrip line electromagnetically coupled to the resonator; and a backshort coupled to the substrate opposite the distal end of the open ended waveguide, wherein the backshort comprises a closed ended waveguide having a reduced scale, with a dimension in a direction of propagation of an electromagnetic wave of an arbitrary fraction of a wavelength.

10. An apparatus providing a transition between a waveguide and a microstrip, comprising:

an open ended waveguide having an exposed side at a distal end;

a substrate couples to the open ended waveguide at a proximate end;

a first resonator coupled to the substrate;

a microstrip line electromagnetically coupled to the resonator;

a backshort coupled to the substrate opposite the distal end of the open ended waveguide;

a second resonator inductively coupled to the first resonator; and a coupling pad electromagnetically coupled to the second resonator.

11. The apparatus according to claim 10, wherein the first resonator and the second resonator are coupled to different sides of the substrate.

12. The apparatus according to claim 11, wherein the substrate is multi-layered.

13. The apparatus according to claim 10, further comprising:

a probe coupled to the first resonator; and an inductive coupling associated with to the microstrip, wherein the probe and the inductive coupling facilitates collection of an incident electromagnetic wave.

* * * * *